US008671501B2

(12) United States Patent
Buckel, Jr. et al.

(10) Patent No.: US 8,671,501 B2
(45) Date of Patent: Mar. 18, 2014

(54) ADJUSTABLE ROLLER FRAME

(75) Inventors: Charles T. Buckel, Jr., Valley City, OH (US); Michael C. Lambertson, Jr., Aurora, OH (US); Sara-Jane A. Anderson, Chesterland, OH (US); Andrew K. Marsden, Avon, OH (US); David Schmitz, Houlton, WI (US); Richard S. Walters, Port Washington, WI (US)

(73) Assignee: The Sherwin-Williams Company, Cleveland, OH (US)

( * ) Notice: Subject to any disclaimer, the term of this patent is extended or adjusted under 35 U.S.C. 154(b) by 217 days.

(21) Appl. No.: 13/168,100

(22) Filed: Jun. 24, 2011

(65) Prior Publication Data

US 2012/0117742 A1 May 17, 2012

Related U.S. Application Data

(60) Provisional application No. 61/358,748, filed on Jun. 25, 2010.

(51) Int. Cl.
*B05C 17/02* (2006.01)

(52) U.S. Cl.
USPC ..... 15/230.11; 492/13

(58) Field of Classification Search
USPC ..... 15/230.11, 230, 144.1, 151, 152; 492/13, 19
See application file for complete search history.

(56) References Cited

U.S. PATENT DOCUMENTS

| | | | | |
|---|---|---|---|---|
| 2,970,366 | A | 2/1961 | Gill | |
| 3,310,831 | A | 3/1967 | Brinker | |
| 3,593,361 | A | 7/1971 | Welt | |
| 3,604,046 | A | 9/1971 | Taylor | |
| 3,745,624 | A | 7/1973 | Newman | |
| 4,868,946 | A | 9/1989 | Marino et al. | |
| D332,009 | S | 12/1992 | Kiefer | |
| 5,288,161 | A | 2/1994 | Graves et al. | |
| 5,806,131 | A | 9/1998 | Tennant | |
| 5,921,905 | A | 7/1999 | Newman, Jr. et al. | |
| 6,519,800 | B2 | 2/2003 | Newman et al. | |
| 6,681,438 | B2 * | 1/2004 | Newman et al. | 15/230.11 |
| 7,784,142 | B2 * | 8/2010 | Scott, Sr. | 15/230.11 |

* cited by examiner

*Primary Examiner* — Shay Karls
(74) *Attorney, Agent, or Firm* — Deron A. Cook; Robert E. McDonald; Vivien Y. Tsang

(57) ABSTRACT

An adjustable roller frame may include a frame, a pair of extension arms that are slidable within a channel in the frame, and a pair of cam assemblies that are used to selectively prevent and permit the extension arms to slide.

14 Claims, 10 Drawing Sheets

ADJUSTABLE ROLLER FRAME

This application claims priority to U.S. Ser. No. 61/358,748, entitled ADJUSTABLE PAINT ROLLER FRAME, filed Jun. 25, 2010, which is incorporated herein by reference.

I. BACKGROUND

A. Field of Invention

The present invention relates generally to paint rollers, and more specifically to adjustable roller frames.

B. Description of the Related Art

It is known to provide adjustable roller frames for supporting roller covers of different lengths or diameters, typically from about 9 inches to about 18 inches in length and from about 1½ inches to about 2¼ inches in diameter. Such adjustable roller frames are used to apply paint or other protective coatings or sealers to relatively large flat surfaces such as floors, walls, or ceilings.

While it is known to provide adjustable roller frames, there is still a need for a low maintenance adjustable roller frame, which is durable and easily adjusts for rollers of different lengths.

II. SUMMARY

According to one embodiment of this invention, an adjustable roller frame may include: a frame having a channel; a first extension arm comprising: a first member; and, a second member having an attachment device that is suitable to attach to an associated roller cover. The first extension arm is adjustable to accommodate different sized roller covers by sliding the first member of the first extension arm within the channel differing amounts. A first cam assembly may comprise: a first cam lever having a first cam surface. The first cam lever is adjustable between: (1) an engaged position where the first cam surface applies a force to the first member of the first extension arm to prevent the first member of the first extension arm from sliding within the channel; and, (2) a released position where the first cam surface permits the first member of the first extension arm to slide within the channel. A first force adjustment device may be adjustable to vary the amount of force applied by the first cam surface to the first member of the first extension arm when the first cam lever is adjusted into the engaged position.

According to another embodiment of this invention, an adjustable roller frame may include: a frame having a channel; a first extension arm comprising: a first member; and, a second member having an attachment device that is suitable to attach to an associated roller cover. The first extension arm is adjustable to accommodate different sized roller covers by sliding the first member of the first extension arm within the channel differing amounts. A first cam assembly may comprise: a first sleeve that is attachable to the frame and that has an opening that receives the first member of the first extension arm; and, a first cam lever that: is pivotally attached to the first sleeve; and, has a cam surface. The first cam lever is pivotal between: (1) an engaged position where the first cam surface applies a force to the first member of the first extension arm to prevent the first member of the first extension arm from sliding within the channel; and, (2) a released position where the first cam surface permits the first member of the first extension arm to slide within the channel.

According to yet another embodiment of this invention, a method may comprise the steps of: (A) providing a first roller cover having first and second attachment surfaces and a size; (B) providing an adjustable roller frame comprising: a frame having a channel with first and second ends; a first extension arm comprising: a first member; and, a second member having an attachment device that is suitable to attach to the first attachment surface of the first roller cover; a second extension arm comprising: a first member; and, a second member having an attachment device that is suitable to attach to the second attachment surface of the first roller cover; a first cam assembly comprising: a first cam lever having a first cam surface; and, a second cam assembly comprising: a second cam lever having a second cam surface; (C) sliding the first member of the first extension arm within the first end of the channel to accommodate the size of the first roller cover; (D) sliding the first member of the second extension arm within the second end of the channel to accommodate the size of the first roller cover; (E) pivoting the first cam lever into an engaged position where the first cam surface applies a force to the first member of the first extension arm to prevent the first member of the first extension arm from sliding within the channel; and, (F) pivoting the second cam lever into an engaged position where the second cam surface applies a force to the first member of the second extension arm to prevent the first member of the second extension arm from sliding within the channel.

Many benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
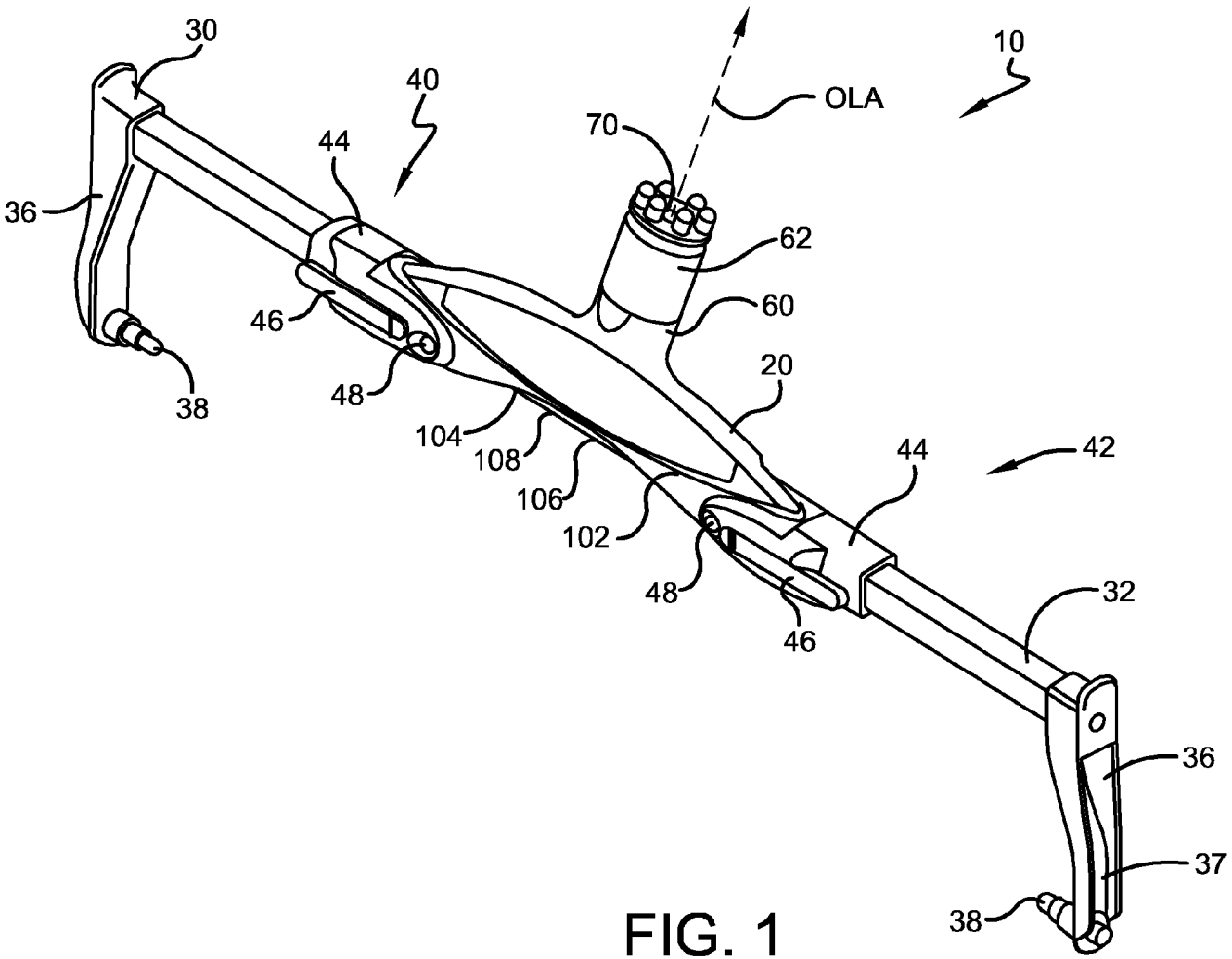
FIG. 1 is a perspective view of an adjustable roller frame.
Figure 2:
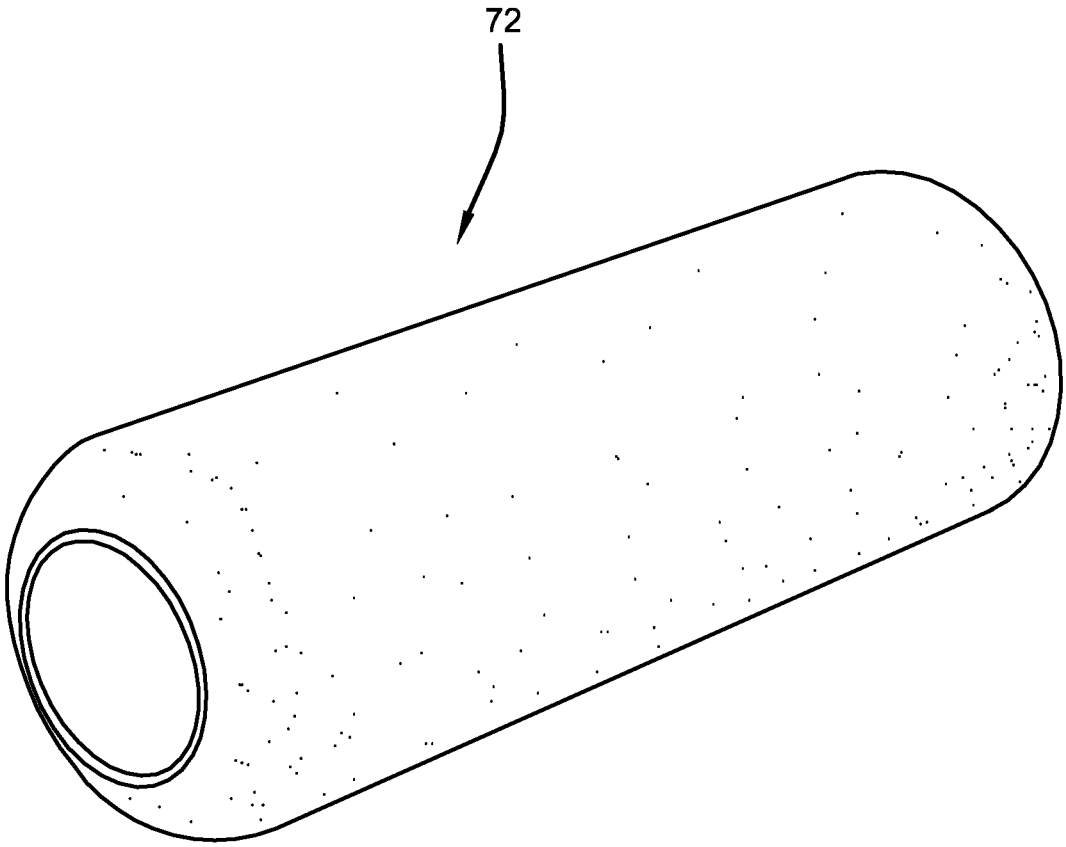
FIG. 2 is a perspective view of a roller cover.

Referring now to the drawings wherein the showings are for purposes of illustrating embodiments of the invention only and not for purposes of limiting the same, and wherein like reference numerals are understood to refer to like components, FIG. 1 shows an adjustable roller frame 10 that may be attached to a roller cover, such as roller cover 72 shown in FIG. 2, for use in rolling the roller cover 72 against a surface to be painted, treated or the like. The adjustable roller frame 10 can be adjusted to attach to various sized roller covers as will be discussed further below. As the use of a roller frame and roller cover is well known to those of skill in the art, further details will not be provided here. The adjustable roller frame 10 may include a frame 20, a pair of extension arms 30, 32, a pair of cam assemblies 40, 42, and a handle or handle attachment mechanism 60, according to one embodiment. The handle or handle attachment mechanism 60 may include an adjustable tool mount 62, which can attach a handle to the adjustable roller frame 10. The handle attachment mechanism 60 may have a handle receiving opening 70 that receives a handle (not shown). The handle receiving opening 70 may have a longitudinal axis OLA, as shown.

Figure 3:
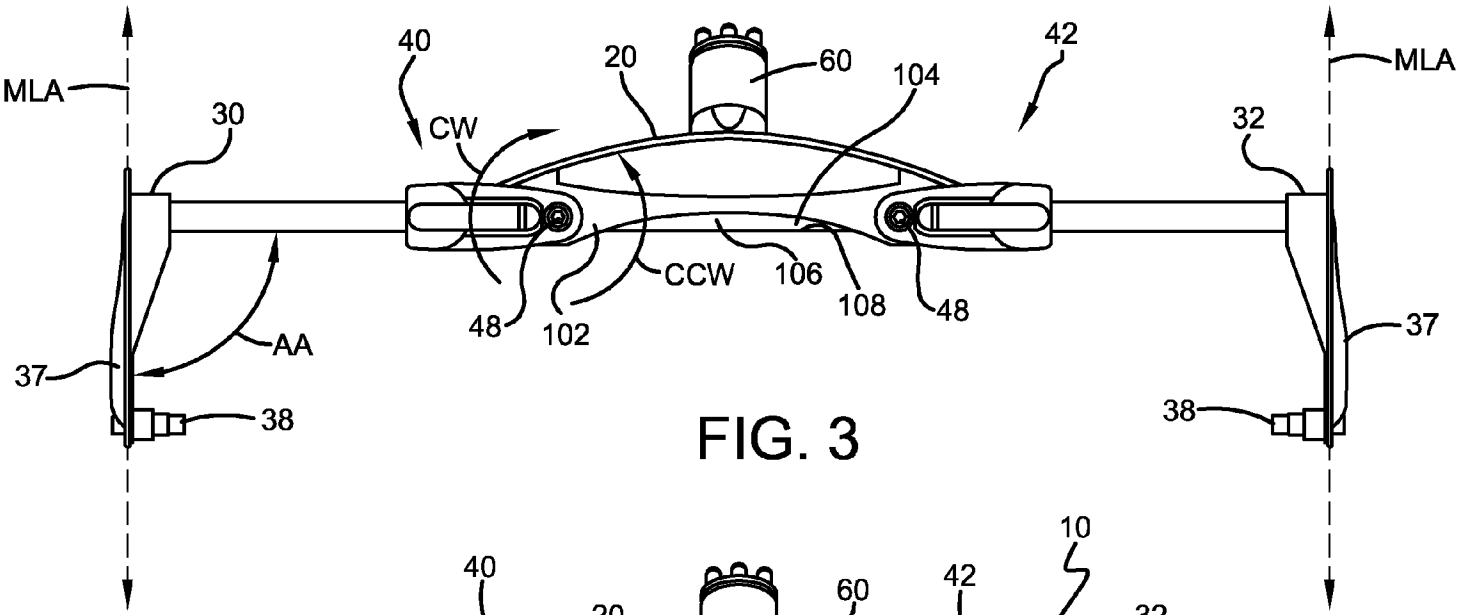
FIG. 3 is a front view of the adjustable roller frame shown in FIG. 1, showing the extension arms adjusted to receive a relatively larger roller cover.

With reference now to FIGS. 1, 3, 5-7, and 9 the frame 20 may include a channel 22 that receives the extension arm 30 at one end and that receives the extension arm 32 at the other end, as shown. The channel 22 may have a longitudinal axis CLA. While the channel 22 may be formed in any manner chosen with the sound judgment of a person of skill in the art, for the embodiment shown, the channel 22 includes an open portion 24 in the middle of the channel 22 and a pair of enclosed or hollow portions 26, 26 on each end of the channel 22. As seen best in FIGS. 6 and 7, a surface of the frame 20 that defines the channel 22 may have indicia 28 that indicate the various sizes of roller covers that the adjustable roller frame 10 can be adjusted to receive. The indicia 28 can be of any style chosen with the sound judgment of a person of skill in the art. In one embodiment, the indicia 28 may include ribs 29 to indicate locations of the extension arms 30, 32 for a specific size roller cover. Each indicium 28 may include a symbol, character, figure, or numeral to indicate the corresponding roller cover size. As one non-limiting example, indicia 28 may have a number (like "14") that indicates 14 inches and a juxtaposed bar that indicates precisely where the 14 inch measurement applies. The frame 20, as shown in FIGS. 1 and 3, may have a front wall 102 with an arched lower edge 104 and a back wall 106 with a straight lower edge 108. The arched lower edge 104 provides a pleasant appearance and the straight lower edge 108 provides structural rigidity.

Figure 4:
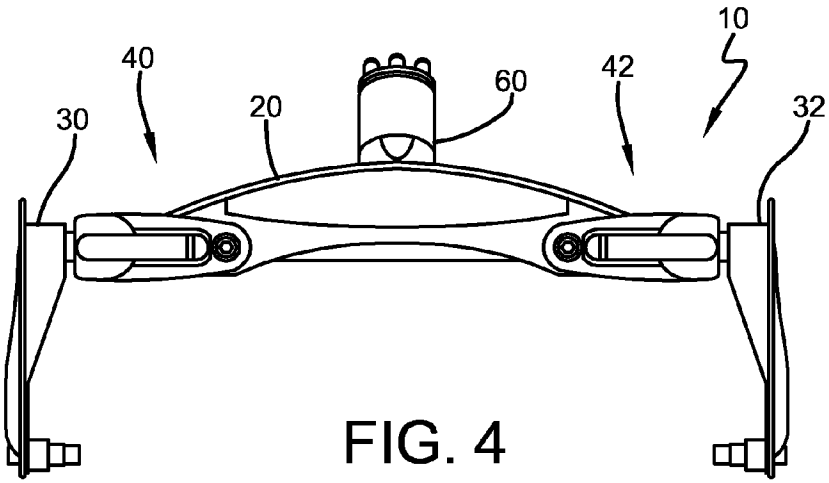
FIG. 4 is a view similar to FIG. 3 but showing the extension arms adjusted to receive a relatively smaller roller cover.

With reference now to FIGS. 1, 3-7, and 12 the extension arms 30, 32 can be identical and interchangeable. Each extension arm 30, 32 may have a first member 34, which slides within the channel 22. In this way, each extension arm 30, 32 is adjustable to accommodate different sized roller covers by sliding the first member 34 within the channel 22 differing amounts. FIG. 3 shows the extension arms 30, 32 adjusted to receive a relatively larger roller cover. FIG. 4 shows the extension arms 30, 32 adjusted to receive a relatively smaller roller cover. In one embodiment, the first member 34 may be formed of aluminum. The first member 34 may have an etched powder coated baked enamel outer surface or a sandblasted outer surface to increase the friction between the first member 34 and the frame 20. The first member 34 may be formed of any other suitable material or combination of materials, such as another metal or plastic and its outer surface may be left untreated or may be surface treated or surface coated to increase friction by any suitable process chosen by a person of ordinary skill in the art. The first member 34 may have any cross-sectional shape chosen by a person of ordinary skill in the art. In one embodiment, the first member 34 has a substantially rectangular cross section. In another embodiment, shown, the first member 34 has a substantially square cross section. While the extension arms 30, 32 may be oriented in any manner chosen with the sound judgment of a person of skill in the art, for the embodiment shown the first members 54, 54 are collinear within the same linear channel 22. Each first member 34 may include a retaining device 35, which retains the extension arm 30, 32 within the channel 22. In one embodiment, the retaining device 35 is a fastener. In another embodiment, the retaining device 35 is a socket cap screw or socket head cap screw. In yet another embodiment, shown best in FIG. 12, the retaining device 35 also serves the function of holding a cap 74 to the end of the first member 34. The cap 74 may serve the function of providing a contact surface in case one first member 34 contacts the other—such as when both extension arms 30, 32 are pushed fully inward. A cap 74 may be provided on each first member 34. As seen best in FIG. 7, the enclosed portion 26 of the channel 22 may include a slot 27, which receives the retaining device 35 and limits the travel of the extension arm 30 outwardly.

With continuing reference to FIGS. 1, 3-7, and 12, each extension arm 30, 32 may also have a second member 36, which extends from the first member 34 at an angle AA as shown in FIG. 3. In one embodiment, angle AA is approximately 90 degrees. In another embodiment, angle AA is between approximately 85 degrees and 95 degrees, inclusive. In another embodiment, angle AA is between approximately 80 degrees and 100 degrees, inclusive. The second member 36 may include one or more ribs 37 to increase the strength while reducing weight. The second member 36 may include an attachment device 38 that is suitable to attach to a roller cover and permit the roller cover to rotate. In one embodiment the attachment device 38 is substantially cylindrical with at least two different diameter portions or steps. For the embodiment shown, each attachment device 38 has three different diameter portions or steps 110 (see FIG. 12). The first member 34 and the attachment device 38 may be attached to the second member 36 in any manner chosen with the sound judgment of a person of skill in the art. In one embodiment, both the first member 34 and the attachment device are press fit into openings 112, 114, formed in the second member 36

Figure 9:
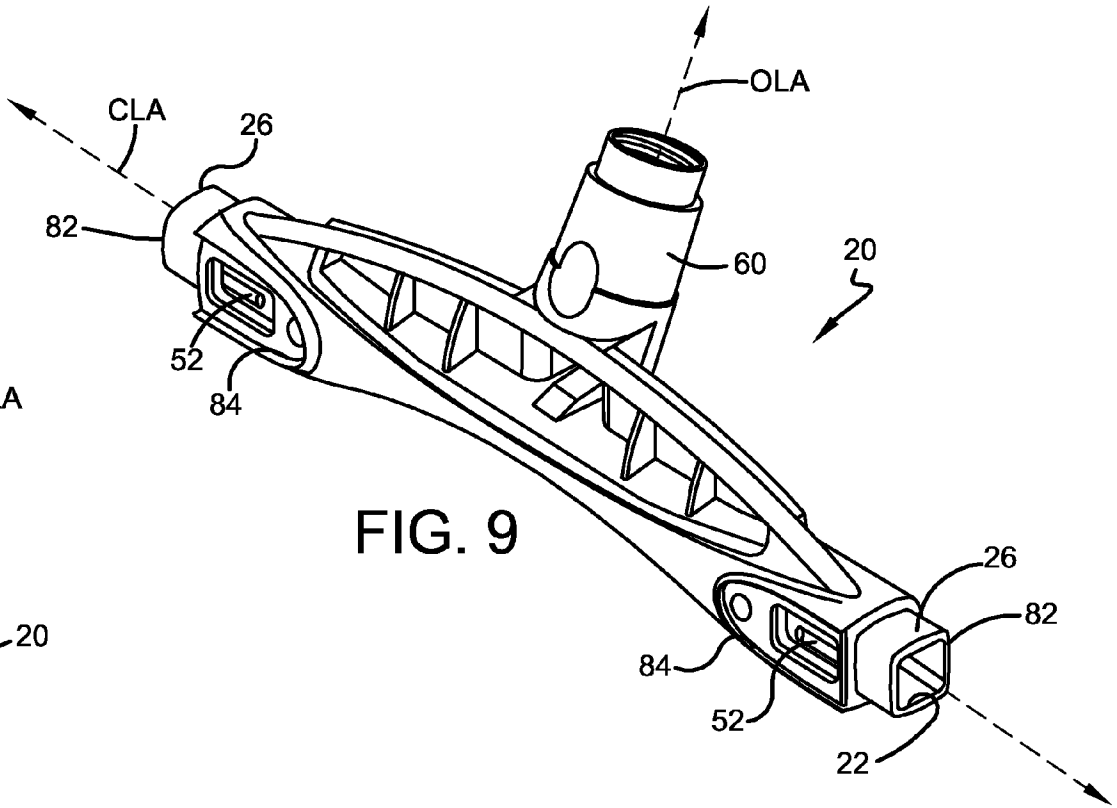
FIG. 9 is a perspective view of a frame.
Figure 8:
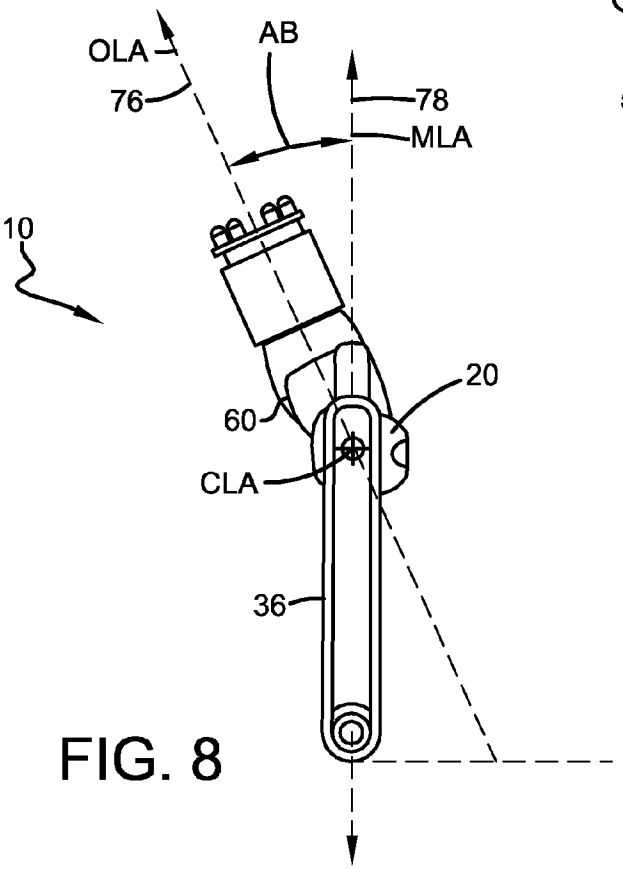
FIG. 8 is an end view of the adjustable roller frame shown in FIG. 1.
Figure 10:
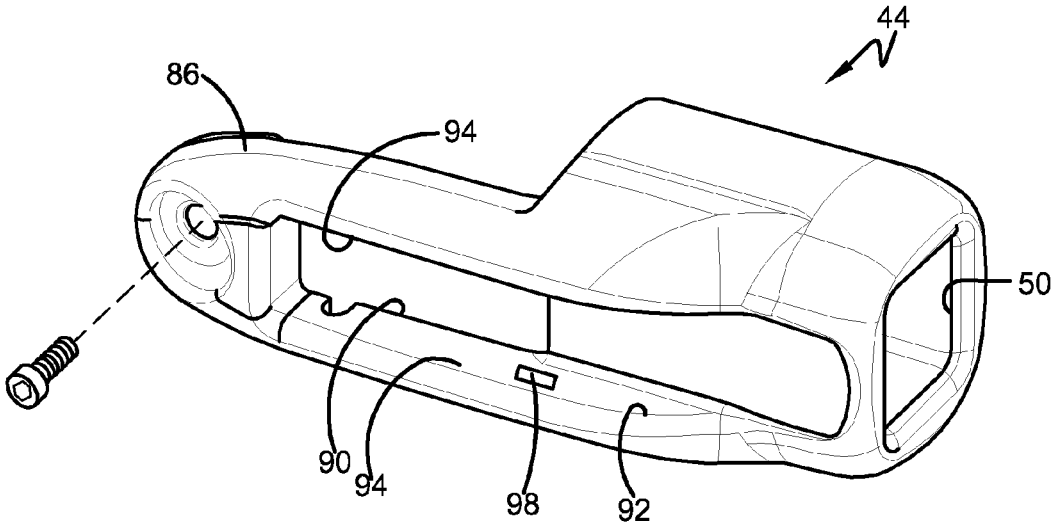
FIG. 10 is a perspective view of a sleeve.
Figure 11:
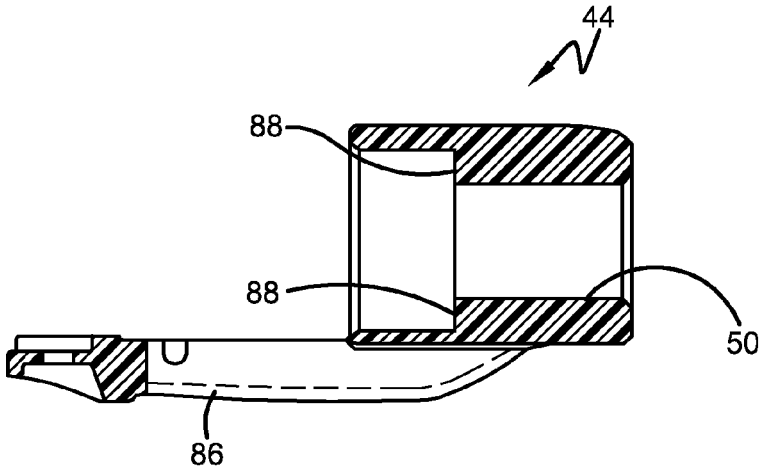
FIG. 11 is a sectional view of the sleeve shown in FIG. 10.
Figure 12:
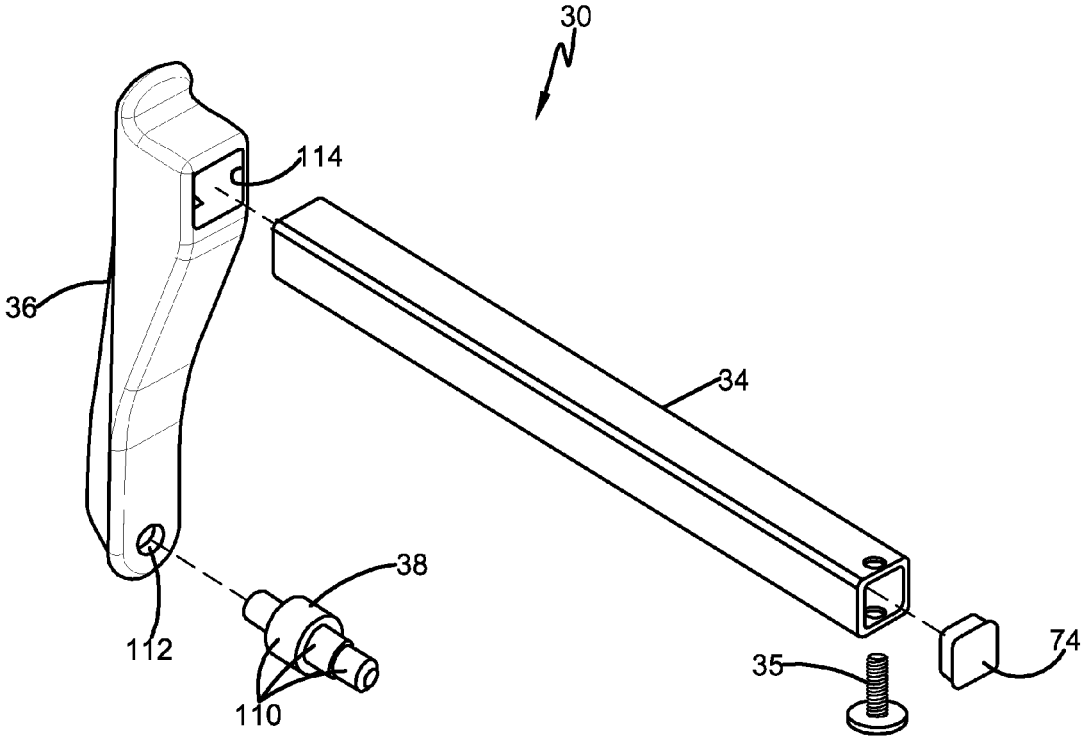
FIG. 12 is an assembly view of an extension arm.
Figure 13:
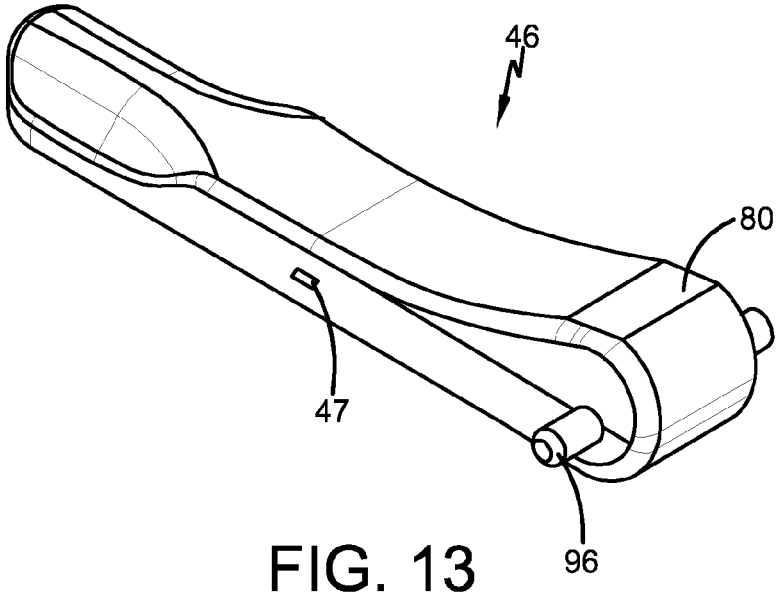
FIG. 13 is a perspective view of a cam lever.
Figure 14:
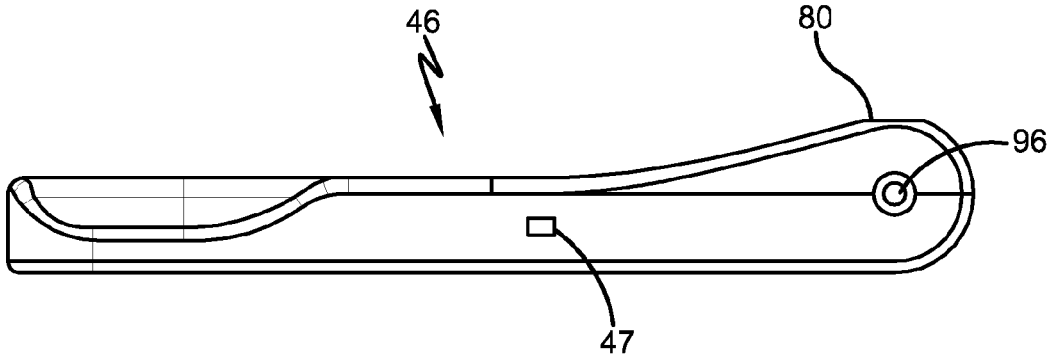
FIG. 14 is a side view of the cam lever shown in FIG. 13.

With reference now to FIGS. 3 and 8-9, each second member 36 may have a longitudinal axis MLA. In one embodiment, shown, the two MLAs are parallel. In a specific embodiment, the acute angle AB formed between a first plane 76 that encompasses the longitudinal axis OLA of the handle receiving opening 70 and is parallel with the longitudinal axis CLA of the channel 22 and a second plane 78 that encompasses the longitudinal axes MLA of the second members 36 and is parallel with the longitudinal axis CLA of the channel 22 is less than 40 degrees. In another embodiment, the acute angle AB is less than 30 degrees. In yet another embodiment, the acute angle AB is about 30 degrees. This acute angle AB is less than known roller frames which are typically angled at 45 degrees. By using an acute angle AB that is less than the prior art, the users of the roller frame 10 can stand closer to the wall, ceiling, floor or other surface they are treating. In one embodiment, both planes 76, 78 also encompass the longitudinal axis CLA of the channel 22.

With reference now to FIGS. 1, 3, 5-7, 10-11 and 13-14, each cam assembly 40, 42 may include a sleeve 44 and a cam lever 46 having a cam surface 80. Each sleeve 44 may be attachable to an end of the frame 20 and may have an opening 50 that receives the first member 34 of the corresponding extension arm 30, 32. In one embodiment, each end of the frame 20 has an extension surface 82 and a cutout 84. The extension surface 82 may be tubular and may define the enclosed portion 26 of the channel 22. To attach the sleeve 44 to the end of the frame 20, the extension surface 82 may be received in the opening 50. Each sleeve 44 may have an extension surface 86 that is received in the cutout 84. The sleeve 44 may also have a shoulder 88 (see FIG. 11) within the opening 50 that limits the distance the sleeve 44 can inserted over the extension surface 82 of the frame 20. Each sleeve may have an aperture 90 and a cam lever receiving slot 92 defined by a pair of walls 94, 94 that face each other, as shown. In one embodiment, the aperture 90 may be positioned between the walls 94, 94.

With continuing reference to FIGS. 1, 3, 5-7, 10-11 and 13-14, each cam lever 46 may be moveably connected to the adjustable roller frame 10 in any manner chosen with the sound judgment of a person of skill in the art. Each cam lever 46 may be adjustable between: (1) an engaged position where the cam surface 80 applies a force to the first member 34 of the corresponding extension arm to prevent the first member 34 from sliding within the channel 22; and, (2) a released position where the cam surface 80 permits the first member 34 of the corresponding extension arm to slide within the channel 22. The cam surface 80, as well known to persons of skill in the art, is a non-uniform or uneven surface that provides cam action to the cam lever 46. The particular non-uniform surface can be any chosen with the sound judgment of a person of skill in the art. In one embodiment, each cam lever 46 is pivotally connected to a sleeve 44. In a specific embodiment, each cam lever 46 pivots about a pivot pin 96 having ends that are supported to the walls 94, 94 of the sleeve 44. For the embodiment shown in FIG. 6, the cam lever 46 is pivoted between the engaged position and the released position by a pivot angle PA of not more than 90 degrees. As the cam lever 46 is pivoted about the pivot pin 96, the cam surface 80 exerts a force through the aperture 90 in the sleeve 44 onto the first member 34 of the corresponding extension arm. For the embodiment shown, as the cam lever 46 is pivoted into the engaged position, the cam lever 46 is received with the cam lever receiving slot 92.

With reference now to FIGS. 1, 5, 10-11 and 13-14, in one embodiment, it is desirable to provide a distinct audible sound to the user when the cam lever 46 is adjusted into the engaged position. This distinct audible sound is not simply the typical sound of components contacting each other but is unique and dissimilar. In one embodiment, this distinct audible sound is achieved by providing at least one tab 47 (for the embodiment shown, one tab 47 is provided on each side of the cam lever 46) that extends from the cam lever 46 and is received within a groove 98 formed in the adjustable roller frame 10. In one embodiment, shown, each groove 98 is formed on one of the walls 94 that define the cam lever receiving slot 92. As the cam lever 46 is pushed into the cam lever receiving slot 92 (and into the engaged position), each tab 47 snaps into the corresponding groove 98 thereby causing the desired distinct audible sound. It has been discovered that the tab 92 does not have to be very large to create the desired distinct audible sound. In one embodiment, the tab 92 extends from the cam lever 46 less than 0.25 inches. In another embodiment, the tab 92 extends from the cam lever 46 less than 0.125 inches.

With reference now to FIGS. 1, 5, 9 and 13-14, in one embodiment, the cam surface 80 directly contacts the first member 34 of the corresponding extension arm. In another embodiment, a component is positioned between the cam surface 80 and the first member 34. This may enhance the life of the cam surface 80. In one specific embodiment, shown, a projection 52 having first and second sides is pivotally attached to the frame 20 and is positioned within an aperture 100 formed in the frame 20. When the cam lever 46 is in the engaged position, the cam surface 80 applies the force to the first side of the projection 52 which causes the second side of the projection 52 to apply the force to the first member 54 of the corresponding extension arm to prevent the first member 54 from sliding within the channel 22. In one embodiment, the projection 52 and aperture 100 are positioned just below the cutout 84.

With reference now to FIGS. 1, 3, 5, 10 and 13-14, adjustable roller frame 10 may also include a force adjustment device 48 that is adjustable to vary the amount of force applied by the cam surface 80 to the first member 54 of the corresponding extension arm when the cam lever 46 is adjusted into the engaged position. The force adjustment device 48 can be of any style and size chosen with the sound judgment of a person of skill in the art. In one embodiment, the force adjustment device 48 adjusts the distance between the cam lever 46 and the first member 54 of the corresponding extension arm. In a specific embodiment, the force adjustment device 48 is a mechanical connector that can be adjusted to tighten the sleeve 44 to the frame 20 (and thus decrease the distance between the sleeve 44 and the frame 20). In another embodiment, shown in FIG. 3, the force adjustment device 48: (1) is rotatable in a first direction CW to increase the amount of force applied by the cam surface 80 to the first member 54 of the corresponding extension arm when the cam lever 46 is adjusted into the engaged position; and, (2) is rotatable in a second direction CCW to decrease the amount of force applied by the cam surface 80 to the first member 54 of the corresponding extension arm when the cam lever 46 is adjusted into the engaged position. In one embodiment, the force adjustment device 48 is a threaded fastener. In a specific embodiment, the force adjustment device 48 is a screw with a lock washer and a flat washer. For the embodiment shown, the force adjustment device 48 can be rotated in a clockwise direction to increase the force and rotated in a counterclockwise direction to decrease the force.

Figure 15:
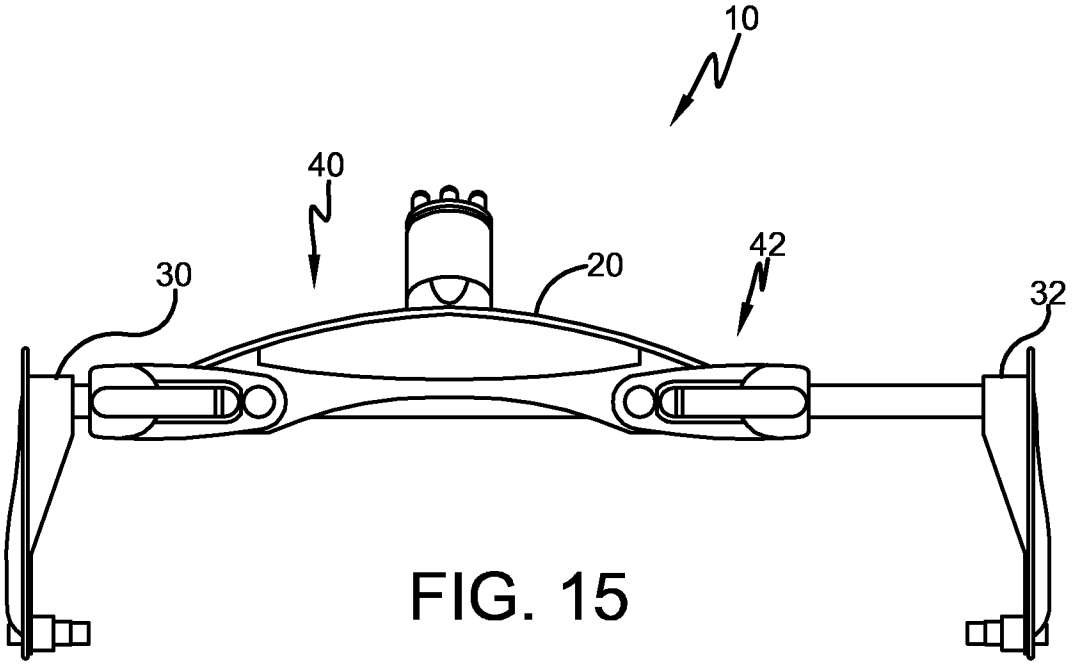
FIG. 15 is a front view of the adjustable roller frame shown in FIG. 1, showing the extension arms in an offset position.

With reference now to all the FIGURES, the operation of the adjustable roller frame 10 will be described. First, a particular roller cover 72 having attachment surfaces and a particular size is selected. The first members 54, 54 of the extension arms 30, 32 are then slid within ends of the channel 22 to accommodate the size of the roller cover as the attachment devices 38, 38 receive the attachment surfaces of the roller cover. The cam levers 46, 46 are then placed into their engaged positions to prevent the first members 54, 54 (and thus the extension arms 30, 32) from sliding. If the adjustable roller frame 10 is equipped with tabs 47 (or the like), this positioning of the cam levers 46, 46 into the engaged positions will create an audible sound. The user can then use the adjustable roller frame 10 and roller cover 72. It should be noted that if the user desires to use the roller cover 72 in an offset position (meaning the roller cover is not centered end to end with the frame), such as to better reach a difficult to access corner in a room being painted, the extension arms 30, 32 can be offset to the left or right from a centerline passing through the center of the frame 20, as shown in FIG. 15.

Figure 5:
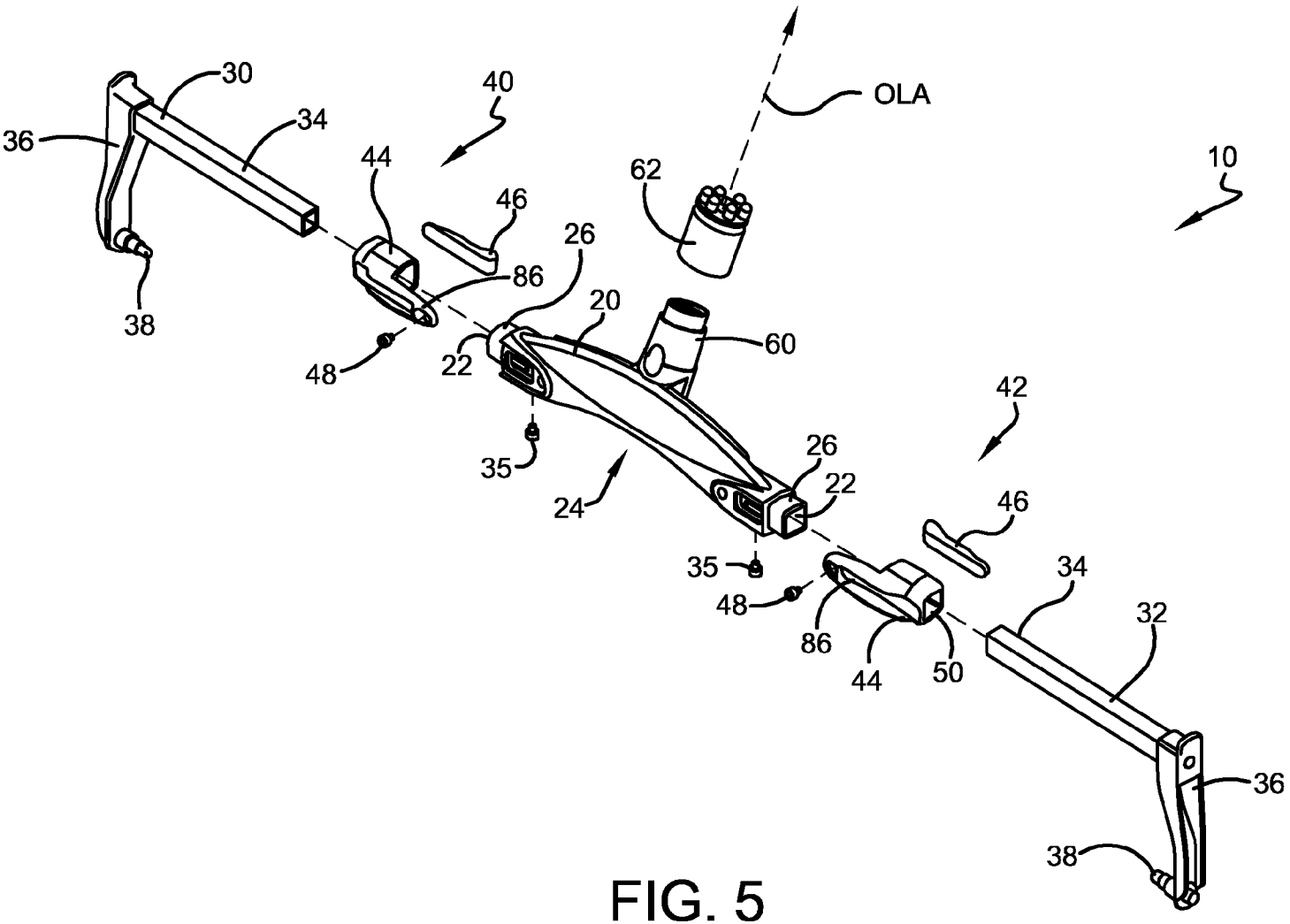
FIG. 5 is an assembly view of the adjustable roller frame shown in FIG. 1.
Figure 6:
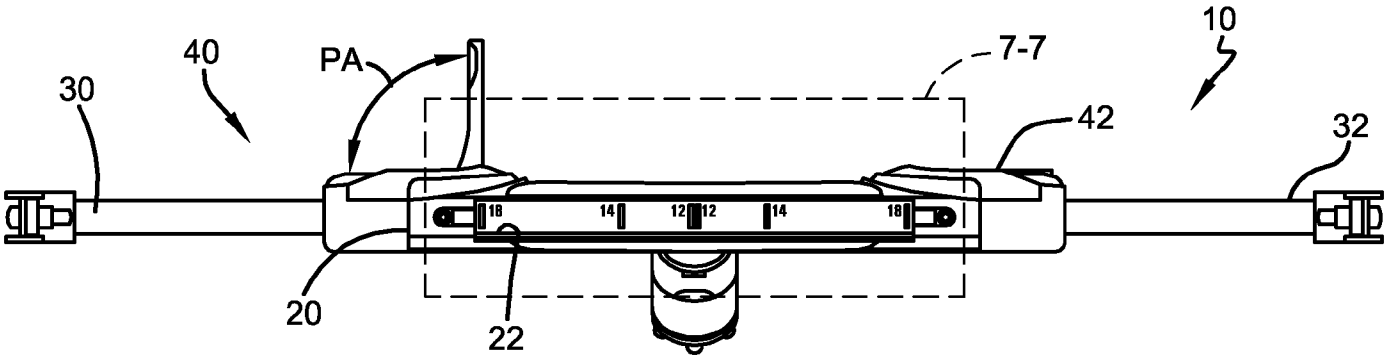
FIG. 6 is a bottom view of the adjustable roller frame shown in FIG. 1.
Figure 7:
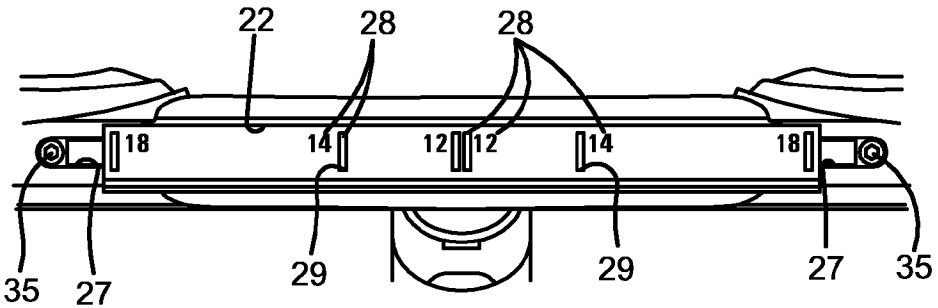
FIG. 7 is a close up view of area 7-7 in FIG. 6.

With continuing reference to all the FIGURES, to remove the roller cover it is only necessary to pivot at least one of the cam levers 46, 46 into the released position, slide the corresponding extension arm(s) outwardly and remove the roller cover. If another roller cover is to be attached, then the same process is repeated except that the first members 54, 54 are slid within ends of the channel 22 to accommodate the size of the new roller cover. In addition, the adjustable roller frame 10 can be disassembled as shown in FIG. 5 for cleaning, replacement, or repair of the various components.

The various components of the adjustable roller frame 10 can be made of any material chosen by a person of ordinary skill in the art, including, but not limited to, metal or plastic. The use of plastic and/or aluminum, as noted above, will advantageously reduce the weight.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

We claim:

1. An adjustable roller frame comprising:

a frame having a channel;

a first extension arm comprising: a first member; and, a second member having an attachment device that is suitable to attach to an associated roller cover;

wherein the first extension arm is adjustable to accommodate different sized roller covers by sliding the first member of the first extension arm within the channel differing amounts;

a first cam assembly comprising: a first sleeve that is attachable to the frame and that has an opening that receives the first member of the first extension arm; and, a first cam lever that: is pivotally attached to the first sleeve; and, has a cam surface; and, wherein the first cam lever is pivotal between: (1) an engaged position where the first cam surface applies a force to the first member of the first extension arm to prevent the first member of the first extension arm from sliding within the channel; and, (2) a released position where the first cam surface permits the first member of the first extension arm to slide within the channel.

2. The adjustable roller frame of claim 1 wherein the first force adjustment device adjusts the distance between the first cam lever and the first member of the first extension arm.

3. The adjustable roller frame of claim 1 wherein the first force adjustment device: (1) is rotatable in a first direction to increase the amount of force applied by the first cam surface to the first member of the first extension arm when the first cam lever is adjusted into the engaged position; and, (2) is rotatable in a second direction to decrease the amount of force applied by the first cam surface to the first member of the first extension arm when the first cam lever is adjusted into the engaged position.

4. The adjustable roller frame of claim 1 wherein:

a projection having first and second sides is pivotally attached to the frame; and, when the first cam lever is in the engaged position, the first cam surface applies the force to the first side of the projection which causes the second side of the projection to apply the force to the first member of the first extension arm to prevent the first member of the first extension arm from sliding within the channel.

5. The adjustable roller frame of claim 1 wherein the first cam lever is pivoted between the engaged position and the released position by a pivot angle of not more than 90 degrees.

6. The adjustable roller frame of claim 1 wherein:

a first tab extends from the first cam lever less than 0.25 inches;

the adjustable roller frame has a first groove; and, the first tab snaps into the first groove as the first cam lever is adjusted into the engaged position to cause a distinct audible sound.

7. The adjustable roller frame of claim 6 wherein:

the first sleeve comprises a cam lever receiving slot defined by first and second walls that face each other;

the first groove is formed in the first wall;

a second groove is formed in the second wall;

the first tab extends from a first side of the cam lever;

a second tab extends less than 0.25 inches from an opposite side of the cam lever;

the second tab snaps into the second groove as the first cam lever is adjusted into the engaged position to cause a distinct audible sound.

8. The adjustable roller frame of claim 1 wherein:

the frame comprises an extension surface and a cutout:

the first sleeve comprises an extension surface that is received in the cutout; and, the extension surface of the frame is received within the opening in the first sleeve.

9. The adjustable roller frame of claim 1 wherein a surface of the frame that defines the channel comprises indicia that indicates the sizes of associated roller covers the adjustable roller frame is adjustable to receive.

10. The adjustable roller frame of claim 1 wherein the first member of the first extension arm is formed of aluminum and has a sandblasted surface to increase the friction between the first member of the first extension arm and the frame.

11. The adjustable roller frame of claim 1 wherein:

the frame has first and second ends and the channel has first and second ends;

the attachment device of the first extension arm is suitable to attach to a first end of the associated roller cover;

the first extension arm is adjustable to accommodate different sized roller covers by sliding the first member of the first extension arm within the first end of the channel differing amounts;

the first sleeve is attachable to the first end of the frame and the opening in the first sleeve receives the first member of the first extension arm;

the adjustable roller frame further comprises:

a second extension arm comprising: a first member; and, a second member having an attachment device that is suitable to attach to a second end of the associated roller cover;

wherein the second extension arm is adjustable to accommodate different sized roller covers by sliding the first member of the second extension arm within the second end of the channel differing amounts;

a second cam assembly comprising: a second sleeve that is attachable to the second end of the frame and that has an opening that receives the first member of the second extension arm; and, a second cam lever that: is pivotally attached to the second sleeve; and has a cam surface;

wherein the second cam lever is pivotal between: (1) an engaged position where the second cam surface applies a force to the first member of the second extension arm to prevent the first member of the second extension arm from sliding within the channel; and, (2) a released position where the second cam surface permits the first member of the second extension arm to slide within the channel; and, wherein the frame has a front wall with an arched lower edge and a back wall with a straight lower edge.

12. The adjustable roller frame of claim 1 wherein:

the frame has first and second ends and the channel has first and second ends;

the attachment device of the first extension arm is suitable to attach to a first end of the associated roller cover;

the first extension arm is adjustable to accommodate different sized roller covers by sliding the first member of the first extension arm within the first end of the channel differing amounts;

the first sleeve is attachable to the first end of the frame and the opening in the first sleeve receives the first member of the first extension arm;

the adjustable roller frame further comprises:

a second extension arm comprising: a first member; and, a second member having an attachment device that is suitable to attach to a second end of the associated roller cover;

wherein the second extension arm is adjustable to accommodate different sized roller covers by sliding the first member of the second extension arm within the second end of the channel differing amounts;

a second cam assembly comprising: a second sleeve that is attachable to the second end of the frame and that has an opening that receives the first member of the second extension arm; and, a second cam lever that: is pivotally attached to the second sleeve; and, has a cam surface;

wherein the second cam lever is pivotal between: (1) an engaged position where the second cam surface applies a force to the first member of the second extension arm to prevent the first member of the second extension arm from sliding within the channel; and, (2) a released position where the second cam surface permits the first member of the second extension arm to slide within the channel; and, wherein the first members are collinear.

13. The adjustable roller frame of claim 1 wherein:

the frame has first and second ends and the channel has first and second ends;

the attachment device of the first extension arm is suitable to attach to a first end of the associated roller cover;

the first extension arm is adjustable to accommodate different sized roller covers by sliding the first member of the first extension arm within the first end of the channel differing amounts;

the first sleeve is attachable to the first end of the frame and the opening in the first sleeve receives the first member of the first extension arm;

the adjustable roller frame further comprises:

a second extension arm comprising: a first member; and, a second member having an attachment device that is suitable to attach to a second end of the associated roller cover;

wherein the second extension arm is adjustable to accommodate different sized roller covers by sliding the first member of the second extension arm within the second end of the channel differing amounts;

a second cam assembly comprising: a second sleeve that is attachable to the second end of the frame and that has an opening that receives the first member of the second extension arm; and, a second cam lever that: is pivotally attached to the second sleeve; and, has a cam surface;

wherein the second cam lever is pivotal between: (1) an engaged position where the second cam surface applies a force to the first member of the second extension arm to prevent the first member of the second extension arm from sliding within the channel; and, (2) a released position where the second cam surface permits the first member of the second extension arm to slide within the channel; and, wherein each attachment device is substantially cylindrical with at least two different diameter portions.

14. The adjustable roller frame of claim 1 wherein:

the frame has first and second ends and the channel has first and second ends;

the attachment device of the first extension arm is suitable to attach to a first end of the associated roller cover;

the first extension arm is adjustable to accommodate different sized roller covers by sliding the first member of the first extension arm within the first end of the channel differing amounts;

the first sleeve is attachable to the first end of the frame and the opening in the first sleeve receives the first member of the first extension arm;

the adjustable roller frame further comprises:

a second extension arm comprising: a first member; and, a second member having an attachment device that is suitable to attach to a second end of the associated roller cover;

wherein the second extension arm is adjustable to accommodate different sized roller covers by sliding the first member of the second extension arm within the second end of the channel differing amounts;

a second cam assembly comprising: a second sleeve that is attachable to the second end of the frame and that has an opening that receives the first member of the second extension arm; and, a second cam lever that: is pivotally attached to the second sleeve; and, has a cam surface;

wherein the second cam lever is pivotal between: (1) an engaged position where the second cam surface applies a force to the first member of the second extension arm to prevent the first member of the second extension arm from sliding within the channel; and, (2) a released position where the second cam surface permits the first member of the second extension arm to slide within the channel; and, wherein the channel has a longitudinal axis;

the adjustable roller frame further comprises a handle attachment mechanism having a handle receiving opening with a longitudinal axis;

the second members each have a longitudinal axis;

the acute angle formed between a first plane that encompasses the longitudinal axis of the handle receiving opening and is parallel with the longitudinal axis of the channel and a second plane that encompasses the longitudinal axes of the second members and is parallel with the longitudinal axis of the channel is less than 40 degrees.

* * * * *